United States Patent [19]

Egli

[11] Patent Number: 5,061,158

[45] Date of Patent: Oct. 29, 1991

[54] MULTI-CYLINDER PISTON PUMP

[75] Inventor: Ernst Egli, Fahrweid, Switzerland

[73] Assignee: Aliva Aktiengesellschaft, Widen, Switzerland

[21] Appl. No.: 449,959

[22] PCT Filed: Mar. 6, 1989

[86] PCT. No.: PCT CH89/00038
§ 371 Date: Nov. 29, 1989
§ 102(e) Date: Feb. 16, 1990

[87] PCT Pub. No.: WO89/09339
PCT Pub. Date: Oct. 5, 1989

[30] Foreign Application Priority Data

Mar. 30, 1988 [CH] Switzerland ..... 1207/88

[51] Int. Cl.[5] ..... F04B 39/10

[52] U.S. Cl. ..... 417/532; 417/519; 417/900

[58] Field of Search ..... 417/900, 519, 532

[56] References Cited

U.S. PATENT DOCUMENTS 4,036,564 7/1977 Richards ..... 417/900
4,174,788 11/1979 Casagrande ..... 417/900

*Primary Examiner*—Leonard E. Smith
*Assistant Examiner*—Charles Freay
*Attorney, Agent, or Firm*—Nilles & Nilles

[57] ABSTRACT

A multi-cylinder piston pump of rotary slide valve design for conveying free flowing materials, in particular concrete, comprises a rotary slide valve (33, 36) connected to the piston (48, 49) and their cylinders (44, 45) with which it pivots. The feeder hopper (4) of the pump is equipped with a stirrer (5) which is actuated only when the pump is in operation. The rotary slide valve (33, 36) is located outside the feeder hopper (4). During the delivery stroke, the axis of the delivery cylinder is coaxial with the longitudinal axis of the adjacent conical pressure pipe (18). This pump is of simpler design than known pumps and is therefore more reliable and requires less maintenance.

7 Claims, 5 Drawing Sheets

MULTI-CYLINDER PISTON PUMP

BACKGROUND OF THE INVENTION

The present invention relates to a multi-cylinder piston pump of the rotary slide valve type for conveying flowable material, particularly concrete.

The multi-cylinder piston pumps that are at the present time used in practice for concrete conveyance are described in an article in "Baumaschinen+Bautechnik", issue No. 2 of February, 1985, by Dipl.-Engineer Alfred Prawit, of Essen, under the title "Analyse der Betonschie-bersysteme" [Analysis of Concrete Pusher Systems]. In this article the advantages and disadvantages of current commercially available concrete pusher systems are explained.

SUMMARY OF THE INVENTION

The present invention has for its object to provide a multi-cylinder piston pump that is more simple in construction and is therefore more functionally reliable in operation than known types and is, in addition, more modest in its requirements for maintenance.

A multi-cylinder piston pump of this type is distinguished by the claimed features.

BRIEF DESCRIPTION OF THE DRAWINGS

An exemplary embodiment of a multi-cylinder piston pump of this type is explained with reference to the drawings, wherein:

FIG. 1 is a side view of a multi-cylinder piston pump with diesel engine, hydraulic pump and understructure, for conveying concrete and the like;

A PREFERRED EMBODIMENT

Figure 1:
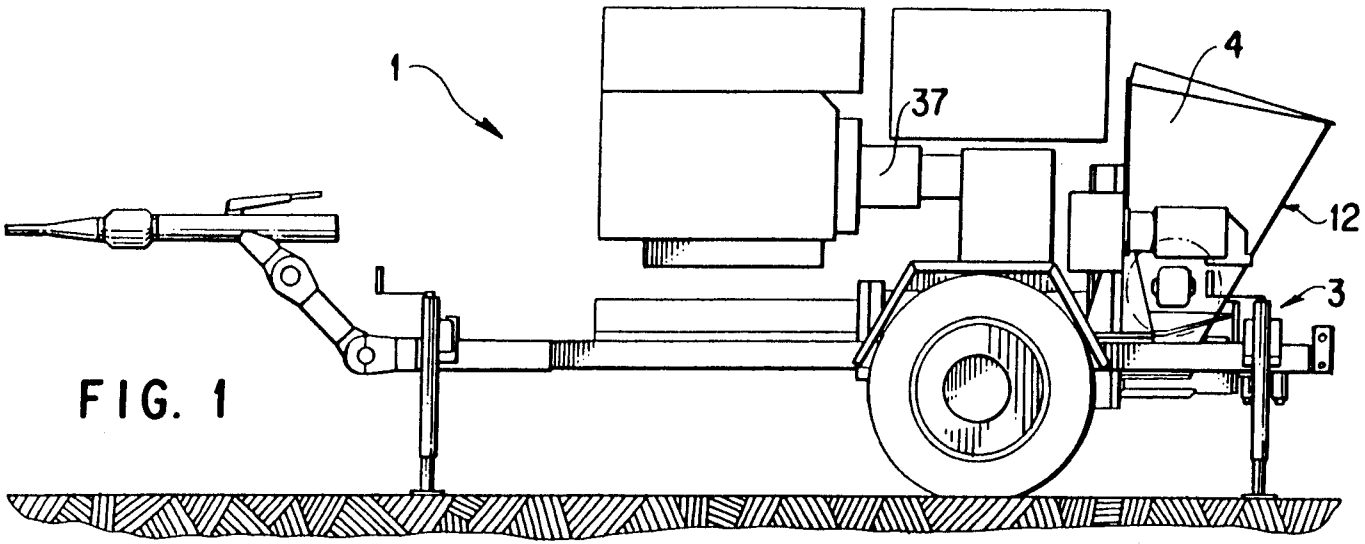
Figure 1A:
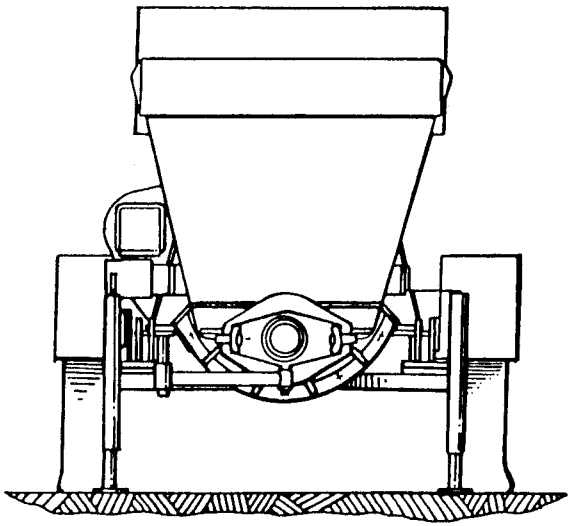
FIG. 1A is a rear view of the multi-cylinder piston pump of FIG. 1

FIG. 1 shows a multi-cylinder piston pump 1 for wet spraying, which can also be designated for conveying caulking, and which particularly serves for delivery of concrete. A complete installation of this type comprises a portable mixer for delivering the material, a concrete pump 3, a dosing pump for blending medium, as well as a nozzle including mixing unit for the addition of pressure air and blending medium as well as a compressor for providing the pressure air.

Figure 2:
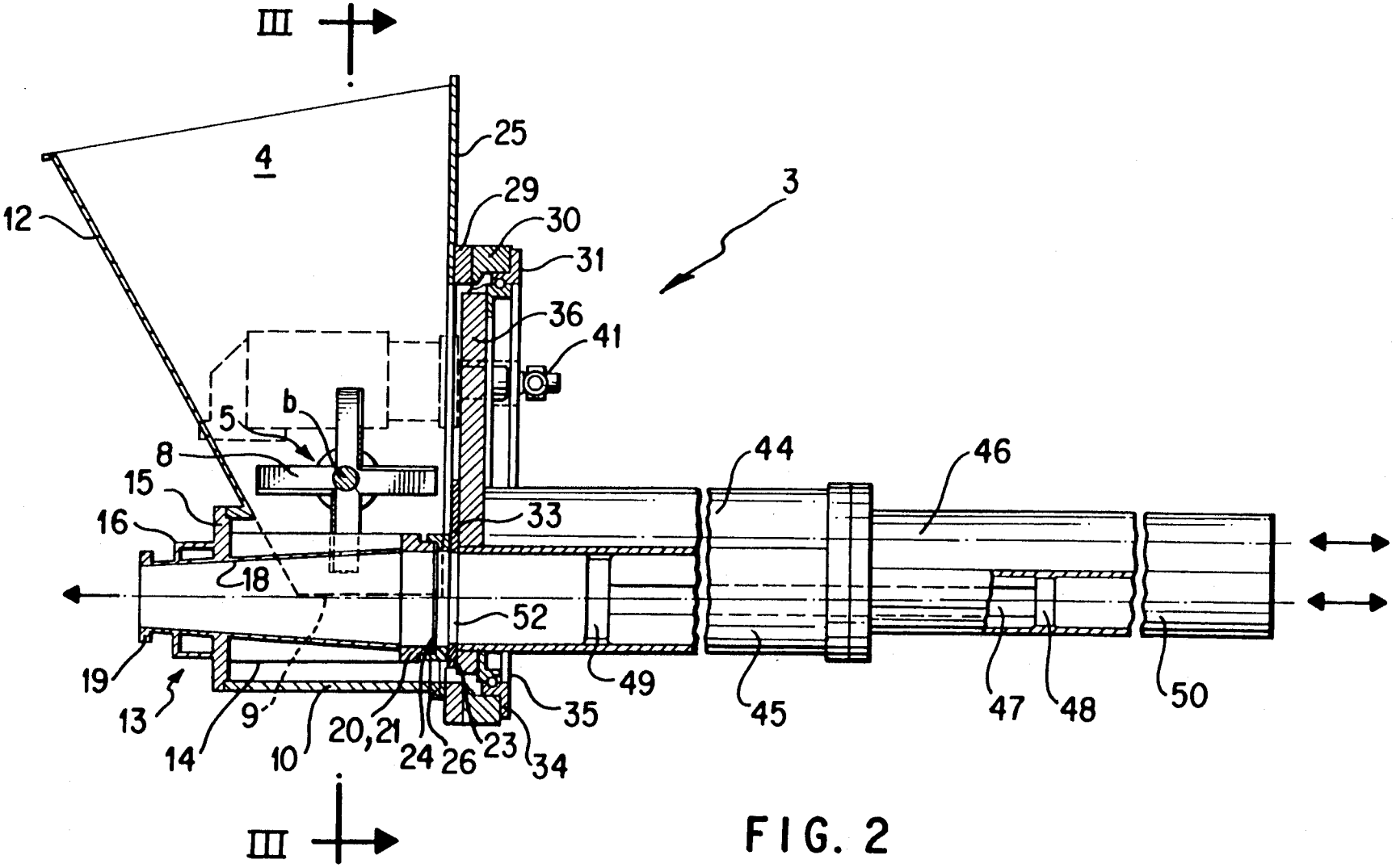
FIG. 2 is a side view, partly in section, of the pumping portion of the multi-cylinder piston pump of FIG. 1.
Figure 3:
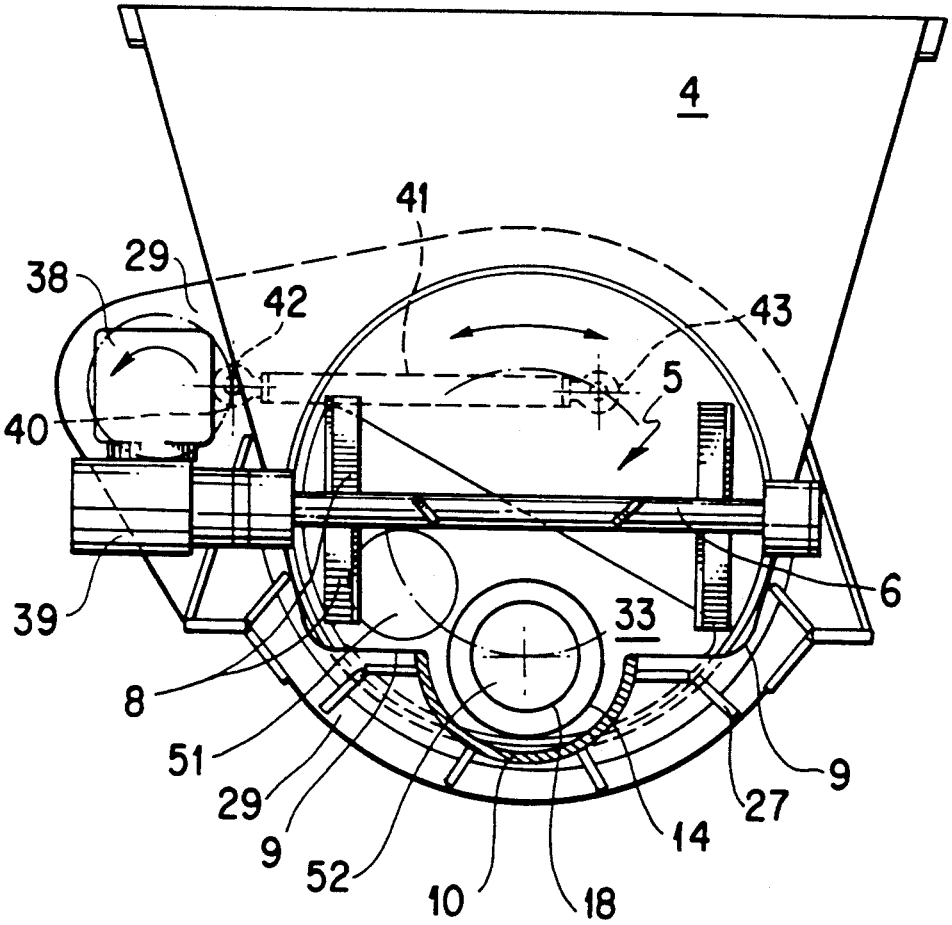
FIG. 3 is a section on the section line III—III of the pump according to FIG. 2, in one end position of the slider.
Figure 4:
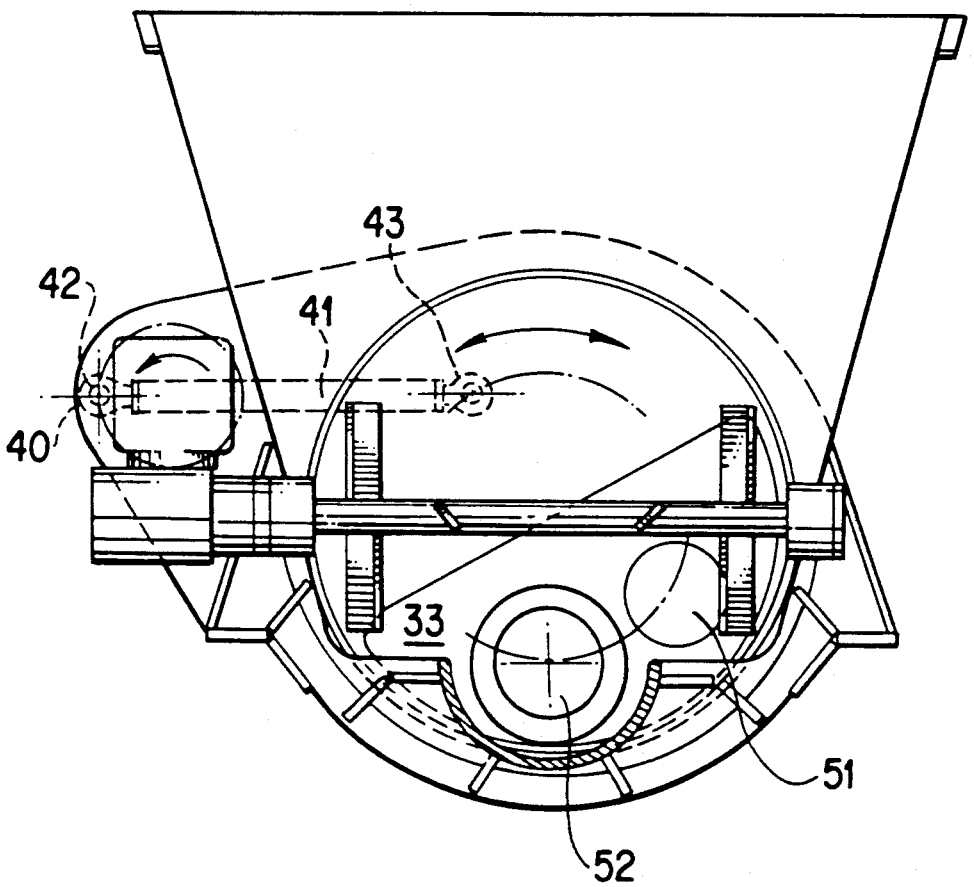
FIG. 4 is a section similar to FIG. 3, with the pump in the other end position of the slider.

In the following there is described only the pump 3 itself. It comprises a hopper 4 for receiving the pumpable concrete mixture, with an agitator 5 having mixing elements 8 formed as arms that are arranged in pairs on a driven shaft 6. (FIGS. 2 to 4.) The hopper 4 is formed at its lower end to an inwardly extending side portion 9 of the hopper bottom, while the connecting hopper bottom middle portion 10 has the form of a trough. This form assures minimum dead space with a minimum residue of concrete at the end of an operation.

To a front closure wall 12 of the hopper 4 there is fastened a pressure pipe carrier 13 which surrounds a cylindrical outer pipe 14, a closure cover 15 and a reinforcement 16. The main portion of this pressure pipe carrier 13 forms a pressure pipe 18 tapering conically in the conveying direction that terminates in a connecting flange 19 and serves for the connection of the spray apparatus itself by means of a more or less elongated feed pipe. This pressure pipe carrier 13 further comprises, at the side opposite the flange 19, an inner end flange 20 which is provided with a circumferential shoulder 21 for receiving the inner end of the cylindrical outer pipe 14. This structural unit of the pressure pipe carrier 13 rests with its inner end flange 20 in a counterflange (cutting ring) 23 with which a sealing ring 24 serves for sealing off and retightening of this transfer location.

Figure 5:
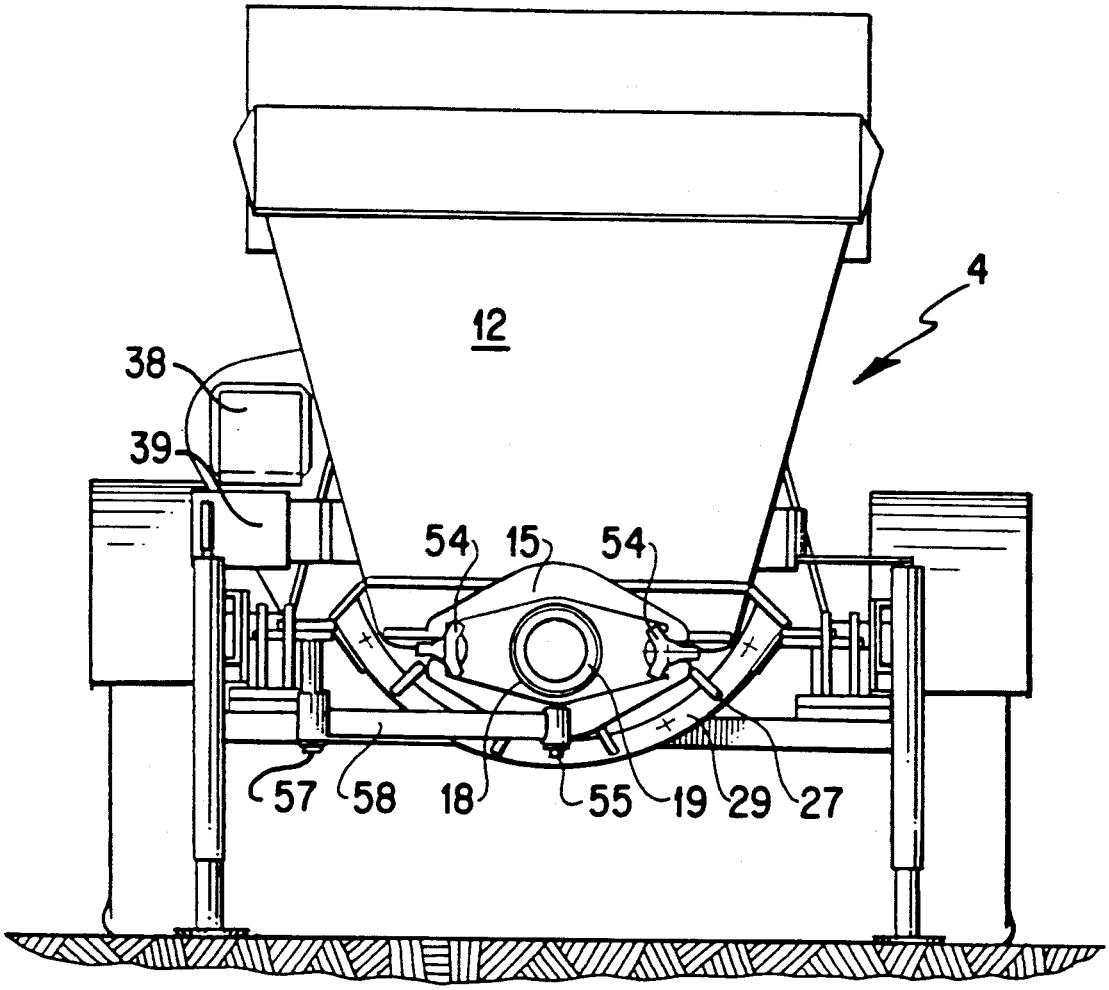
FIG. 5 is a view in elevation from the front side of the multi-cylinder pump according to FIG. 1.

As FIG. 5 shows, the closure cover 15 of the pressure pipe carrier 13 is secured by means of two lateral tension screws 54. At the bottom of the closure cover 15 there is provided a trunnion 55 that serves for mounting a swinging arm 58 which has its other end journaled on a chassis trunnion 57. This simple construction makes it possible, after loosening of the two tension screws 54, for the entire pressure pipe carrier 13 to ride out of its working position by means of the closure cover 15 and the trunnions 55 and 57 as well as the swinging arm 58, for being cleaned in a simple manner. Through this there is also assured a good access to the under portion of the hopper 14, which is also particularly important for cleaning after the end of the work. All portions are consequently very easily accessible for replacement or their inspection and maintenance.

As can be seen from FIG. 2, there is provided, as a rear closure for the stationary portion of the pump 3, a rear wall 25 which extends to the lower portion of a reinforcing segment 26, likewise belonging to the stationary part of the pump 3. This reinforcing segment 26 can be seen in FIGS. 2 to 4. This segment 26 is reinforced with ribs 27 in order to take up the large reaction forces of pumping. The ribs 27 are further connected with an outer flange ring segment 29 which has the form seen in FIGS. 3 and 4. The segment 29 is screwed to a ring flange 30. The ring flange 30 serves, among other things for securement of a lip seal 31 that lies against the outer flange ring segment 29 in a manner that can be seen in FIG. 2. To the ring flange 30 there is secured a ball-bearing outer ring 34, while the associated ball-bearing inner ring 35 is screwed to a very massive drive plate 36. This drive plate 36 is the carrier of one of the most important parts of the concrete pump 3, a so-called spectacle plate 33 which is of half-circular form, as FIGS. 3 and 4 show, and which is provided with two intake or outlet openings 51 and 52 that are spaced equal distances from the rotational axis of the spectacle plate 33.

The drive plate 36 is connected with a hydraulic motor 38 which, by means of a crank arm 40 and a connecting rod 41 as well as two link pins 42 and 43, swings the drive plate 36, and with it the spectacle plate 33, back and forth through a swinging zone of about 60°, that is, traversing 30° each way about the middle normal plane of the pump 3, with a switching time of, for example, 0.5 sec. The hydraulic motor drives the crank drive in only one direction.

As can be seen particularly from FIG. 2, the extremely robustly constructed drive plate 36 serves for mounting two cylinders 44 and 45 of the concrete pump 3. In each of these cylinders 44 and 45 there is a double piston 47 with a hydraulic piston 48 at one end and a concrete piston 49 at the other end of the common piston rod. The hydraulic drive of the piston 48, along with the entire remaining control mechanism, is not illustrated. It does not form subject matter of the present invention, but it ensures the synchronization of the interdependent movements of the parts needed for concrete conveyance.

With this construction the concrete-filled hopper 4 contains no moving parts except for the agitator 5, which is also driven by means of a hydraulic motor 39. It is therefore also not necessary, as has heretofore been provided, in changing over from suction chamber to pressure chamber and the reverse, to unnecessarily push a portion of the concrete mass that is in the concrete hopper 4, besides which, also, analogous delicate sealing problems as well as forces and moments, that is, configurations which have heretofore often led to difficulties, can largely be surmounted without problems. With the described embodiment of a concrete pump the parts that are not required by their functions to be movable in the hopper, that is, the agitator 5, are mounted on the outer side of the hopper 4. The spectacle plate 33, serving as a sliding control valve, by its swinging brings into transient connection with the inlet to the conical pipe 18 whichever of the cylinders 44 or 45 has been filled with concrete. Thereafter the corresponding concrete piston 49 begins in this position, as FIGS. 2 and 3 show, to convey through the conical pressure pipe to the spray nozzle, in the direction indicated by the arrow, the mass of concrete taken up during the preceding stroke by rearward travel of that piston 49 in the cylinder 45. In this the concrete piston 49 seen in FIG. 2 moves about to the cutoff plane of the spectacle plate 33, to its dead center position. With the next stroke, in which the cylinder 45 in the position seen in FIG. 4 is changed around, the cylinder 44, filled with concrete, arrives at the discharge position seen in FIG. 2.

It would be basically possible, however, to allow the pressure piston—the piston 49 according to FIG. 2—to advance into the hopper counterflange 23 in order, after its return, to obtain if necessary an easier swinging of the spectacle plate 33 during reversal.

While thus, as FIG. 2 shows, the there visible concrete piston 49 in cylinder 45 discharges the previously indrawn concrete mass into the conical pressure pipe 18, the other concrete piston 49 in the cylinder 44 in FIG. 2, moving rearwardly in its opposite stroke, creates a suction so that concrete flows out of the hopper 4 into this space, along with which the agitator 5, rotating in the counterclockwise direction according to FIG. 2, assists the inflow of this concrete into the cylinder 44.

The various drive elements, such as hydraulic motor 38 and hydraulic cylinders 46, 50, are so synchronized that the reversing of the drive plate 36 with the spectacle plate 33 takes place in the dead center region of the two concrete conveying pistons 49 so that, as FIG. 4 shows, the whole cylinder 44 overlies the inlet opening of the conical pressure pipe 118 while the emptied cylinder 45 opens into the interior of the hopper 4 and, with the subsequent rearward movement of the piston 49 thereof, that cylinder 45 fills with concrete.

The described concrete pump solves the posed problem in all respects. It is also structurally extremely compact. The delivery of concrete always takes place linearly through the stationary conical pressure pipe 18, which not only is conducive to negligible wear but also to small pressure loss. The rotationally movable portions for reversing do not lie in the hopper, as in prior constructions, but, instead, at the exterior; because the drive plate 36 with the spectacle plate 33 is the carrier of the two cylinders 44 and 45. In some cases more than two cylinders can be provided in multi-cylinder machines. Through this the linear conveyance is assured and the avoidance of unnecessary movement of concrete masses is obtained. The wearing parts can be replaced in a simple manner. Also the rinsing out of the pressure pipe carrier in the manner explained is extremely simple, the loss volume in the hopper is minimal in relation to the concrete mass, and the feed of concrete during the suction strokes of the concrete pistons in the respective cylinders is assured by the now possible deep arrangement of the agitator. Along with this, too, many of the delicate places of prior pumps have been eliminated or brought into easily accessible regions, which works out advantageously in every respect.

I claim:

1. Two-cylinder piston pump with material hopper of the rotary slide valve type for conveying flowable material, particularly concrete, wherein a rotary slide valve (33, 36) is connected with the pistons (48, 49) and their cylinders (44, 45) for common actuation and the rotary slide valve (33, 36) is arranged outside the material hopper (4), characterized by a pressure pipe carrier (13) with pressure pipe (18) and with an inner flange (20) arranged in the material hopper and with a counterflange formed as a cutting ring (23), wherein the outwardly opening connecting location between the inner flange and the counterflange lies in the interior of the material hopper (4).

2. Two-cylinder piston pump according to claim 1, characterized in that a structural unit, contained in the pressure pipe (18), is provided for removable insertion in the hopper, which is secured by tensioners (54) so that the structural unit is supported for, being slid out (55, 57, 58).

3. Two-cylinder piston pump according to claim 1, characterized in that the rotary slide valve (33, 36) with connected pistons (48, 49) and their cylinders (44, 45) are formed as a structural unit removable from the hopper (4).

4. Two-cylinder piston pump according to claim 1 characterized in that in the pressure conveying phase of the material to be conveyed the conveying cylinder axis is coaxial with the longitudinal axis of the adjacent, conical pressure pipe (18).

5. Two-cylinder piston pump according to claim 1 characterized in that the rotary slide valve comprises a spectacle plate (33) along with a drive plate (36) connected with it which is mounted on bearings.

6. Two-cylinder piston pump according to claim 5, characterized in that the drive plate (36) is driven by means of a crank drive.

7. Two-cylinder piston pump according to claim 1 characterized in that the regions of the free ends of the cylinders are supported upon a common roller train.

* * * * *